US010500856B2

(12) United States Patent
Wong et al.

(10) Patent No.: US 10,500,856 B2
(45) Date of Patent: Dec. 10, 2019

(54) INK JET HEAD AND INK JET RECORDING APPARATUS

(71) Applicant: TOSHIBA TEC KABUSHIKI KAISHA, Tokyo (JP)

(72) Inventors: Meng Fei Wong, Mishima Shizuoka (JP); Ryutaro Kusunoki, Mishima Shizuoka (JP); Shuhei Yokoyama, Mishima Shizuoka (JP); Ryuichi Arai, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/913,577

(22) Filed: Mar. 6, 2018

(65) Prior Publication Data

US 2018/0194136 A1 Jul. 12, 2018

Related U.S. Application Data

(63) Continuation of application No. 15/437,190, filed on Feb. 20, 2017, now Pat. No. 9,937,718.

(30) Foreign Application Priority Data

Apr. 20, 2016 (JP) ..... 2016-084587

(51) Int. Cl.
*B41J 2/14* (2006.01)

(52) U.S. Cl.
CPC ..... *B41J 2/14233* (2013.01); *B41J 2/14201* (2013.01); *B41J 2002/14459* (2013.01); *B41J 2002/14491* (2013.01); *B41J 2202/15* (2013.01)

(58) Field of Classification Search
CPC ..... B41J 2/14233; B41J 2/14201; B41J 2202/15; B41J 2002/14459; B41J 2002/14491
See application file for complete search history.

(56) References Cited

U.S. PATENT DOCUMENTS

| | | | |
|---|---|---|---|
| 5,927,319 | A | 7/1999 | Burkhalter |
| 8,876,262 | B2 | 11/2014 | Arai et al. |
| 2007/0070128 | A1 | 3/2007 | Inoue |
| 2013/0063522 | A1 | 3/2013 | Arai et al. |
| 2013/0070027 | A1 | 3/2013 | Arai et al. |
| 2016/0279933 | A1 | 9/2016 | Arai et al. |

OTHER PUBLICATIONS

IP.com search (Year: 2019).*
IP.com search.
European Office Action dated Jul. 2, 2019, mailed in counterpart European Application No. 17161476.1, 5 pages.

* cited by examiner

*Primary Examiner* — Lisa Solomon
(74) *Attorney, Agent, or Firm* — Kim & Stewart LLP

(57) ABSTRACT

According to one embodiment in an inkjet head, the common electrodes for all the actuators, without overlapping with the first wiring pattern formed by individual electrodes, are connected to a second wiring pattern that passes between the outer peripheral portion of piezoelectric bodies, and a third wiring pattern that extends in a direction different from a direction of the second wiring pattern. The first wiring pattern and the third wiring pattern are electrically insulated at intersections thereof.

20 Claims, 8 Drawing Sheets

INK JET HEAD AND INK JET RECORDING APPARATUS

CROSS-REFERENCE TO RELATED APPLICATIONS

This application is a continuation of U.S. patent application Ser. No. 15/437,190, filed on Feb. 20, 2017, which is based upon and claims the benefit of priority from Japanese Patent Application No. 2016-084587, filed on Apr. 20, 2016, the entire contents of each of which are incorporated herein by reference.

FIELD

Embodiments described herein relate generally to an ink jet head and an ink jet recording apparatus.

BACKGROUND

Generally, a piezoelectric ink jet head includes a nozzle substrate with piezoelectric material. This inkjet head can include a plurality of piezoelectric actuators, each having a nozzle at one end of a corresponding pressure chamber.

In conventional ink jet heads, an actuator includes a piezoelectric body on a vibrating plate, a common electrode electrically connected to the piezoelectric body, and an individual electrode electrically connected to the piezoelectric body. The piezoelectric body is interposed between the individual electrode and the common electrode. Wiring patterns connected to the individual electrode and the common electrode respectively are separated from each other without overlapping on the vibrating plate.

Printing quality can be improved by adopting a high density nozzle array. For such design, a wiring pattern is electrically connected to a portion between adjacent actuators in order to perform wiring of a plurality of conductive patterns of the common electrode, while another wiring pattern is connected to the individual electrode of each actuator.

DETAILED DESCRIPTION

For an apparatus with a configuration described in the relevant literature, when electrical breakdown occurs causing disconnection in the wiring connected to the common electrode, some of the actuators are disconnected from the common electrode.

According to one embodiment, an ink jet head and an ink jet recording apparatus that can reliably maintain an electrical connection even when any one common electrode in the high density nozzle array is disconnected are provided.

In general, according to one embodiment, an inkjet head includes a plurality of nozzles and a plurality of actuators corresponding to this plurality of nozzles. The plurality of actuators causes ink to be ejected from the plurality of nozzles by pressurizing the ink. Each actuator includes a piezoelectric body, a common electrode, and an individual electrode. The individual electrode is electrically connected to an individual portion of a first wiring pattern disposed on a vibrating plate. Each of the common electrodes of the actuators is connected to a second wiring pattern disposed on the vibrating plate separated from the first wiring pattern. The second wiring pattern is electrically connected to a wiring portion that passes between the outer peripheral portions of the plural piezoelectric bodies. A third wiring pattern is disposed on the vibrating plate, extends in a direction different from a direction of the second wiring pattern, and is electrically connected to the second wiring pattern. The first wiring pattern and the third wiring pattern are electrically isolated at intersections thereof.

Hereinafter, the first embodiment will be described with reference to FIGS. 1 to 5A and 5B. There is a case of using other expressions of one or more in each element which can be expressed, using a plurality of expressions. However, it is not a situation of denying a case of using a different expression with respect to an element in which another expression is not used, and also is not a situation of limiting a case of using another expression which is not exemplified. In addition, each figure schematically illustrates the embodiment, and there is a case in which a dimension of each element illustrated in figures is different from descriptions in the embodiment.

Hereinafter, a wiring pattern of an ink jet head 1 according to the embodiment will be described. Each figure is schematically plotted for promoting easier understanding. Since there may be cases where a portion in which a shape, a dimension, a proportion, or the like, thereof is different, designs thereof can be appropriately modified.

Figure 1:
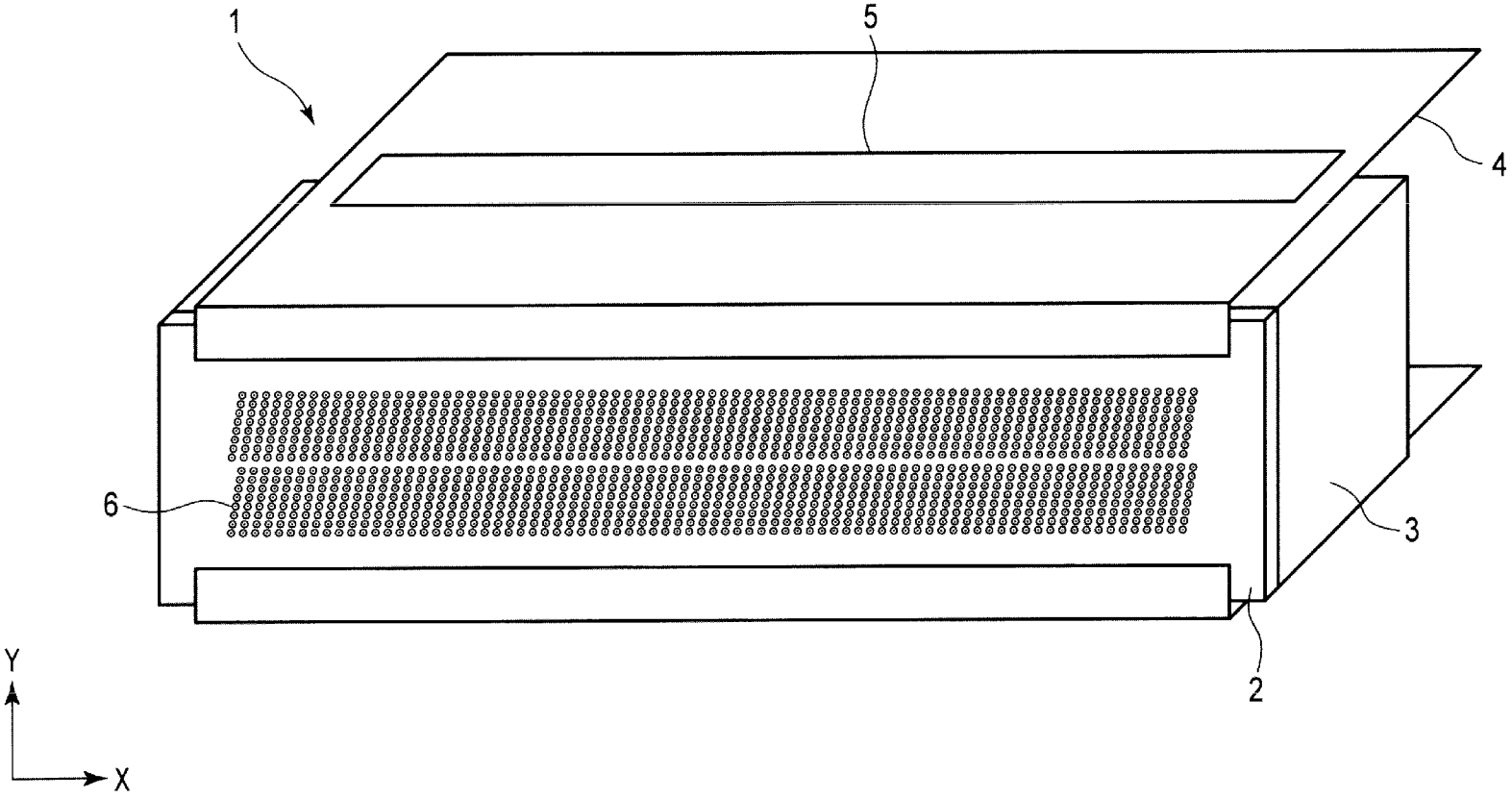
FIG. 1 is a perspective view illustrating an inkjet head according to a first embodiment.

FIG. 1 is an external perspective view illustrating the ink jet head 1 according to a first embodiment.

The ink jet head 1 includes a flow path substrate 2, an ink supply unit 3, flexible wiring boards 4, and driving circuits 5.

Actuators 6 that eject the ink from nozzles 17 (illustrated in FIGS. 3 and 4 described below) are arranged in an array on the flow path substrate 2. A plurality of the nozzles 17 are linearly arranged in an oblique direction and at a constant angle with respect to a Y direction, which is the transportation direction of the recording sheet P (a recording medium). In addition, in FIG. 1, an arrow X denotes a longitudinal direction of the ink jet head 1. The longitudinal direction of the ink jet head 1 denotes a direction orthogonal to the transportation direction of the recording sheet P denoted by an arrow Y, and coincides with the width direction of the recording sheet P.

Nozzles 17 are arranged at even intervals in a direction orthogonal to a printing direction without overlapping each other in the printing direction. Each actuator 6 is electrically connected to the driving circuits 5 through the flexible wiring boards 4. The driving circuits 5 are electrically connected to a control circuit (not illustrated), which performs printing control. The flow path substrate 2 and the flexible wiring boards 4 are bonded together and are electrically connected using an anisotropic conductive film (ACF). The flexible wiring boards 4 and the driving circuits 5 are bonded together and electrically connected using chip on flex (COF), for example.

The ink supply unit 3 includes an ink supply port (not illustrated), which is connected to a tube or the like and supplies ink through the ink supply port to the flow path substrate 2. The flow path substrate 2 and the ink supply unit 3 are bonded together using, for example, an epoxy-based adhesive.

When the ink is supplied from the ink supply port and the driving circuit 5 sends an electric signal (also referred to as driving signal) to the actuator 6, the actuator 6 vibrates, pressurizing the ink filled in a pressure chamber 18 (illustrated in FIG. 4 described below) inside of the flow path substrate 2. The ink is then ejected from the nozzle 17, in which the actuator 6 is disposed, in a direction perpendicular to the surface of the flow path substrate 2. In other words, the driving circuit 5 supplies an electric signal to the actuator 6. The actuator 6 causes a pressure vibration in ink by changing the volume of the pressure chamber 18 according to the electric signal. In this manner, the nozzle 17 ejects the ink from the pressure chamber 18.

In an embodiment, ink is supplied to the ink supply port at a pressure that is lower than the atmospheric pressure by approximately 1000 Pa.

Figure 2:
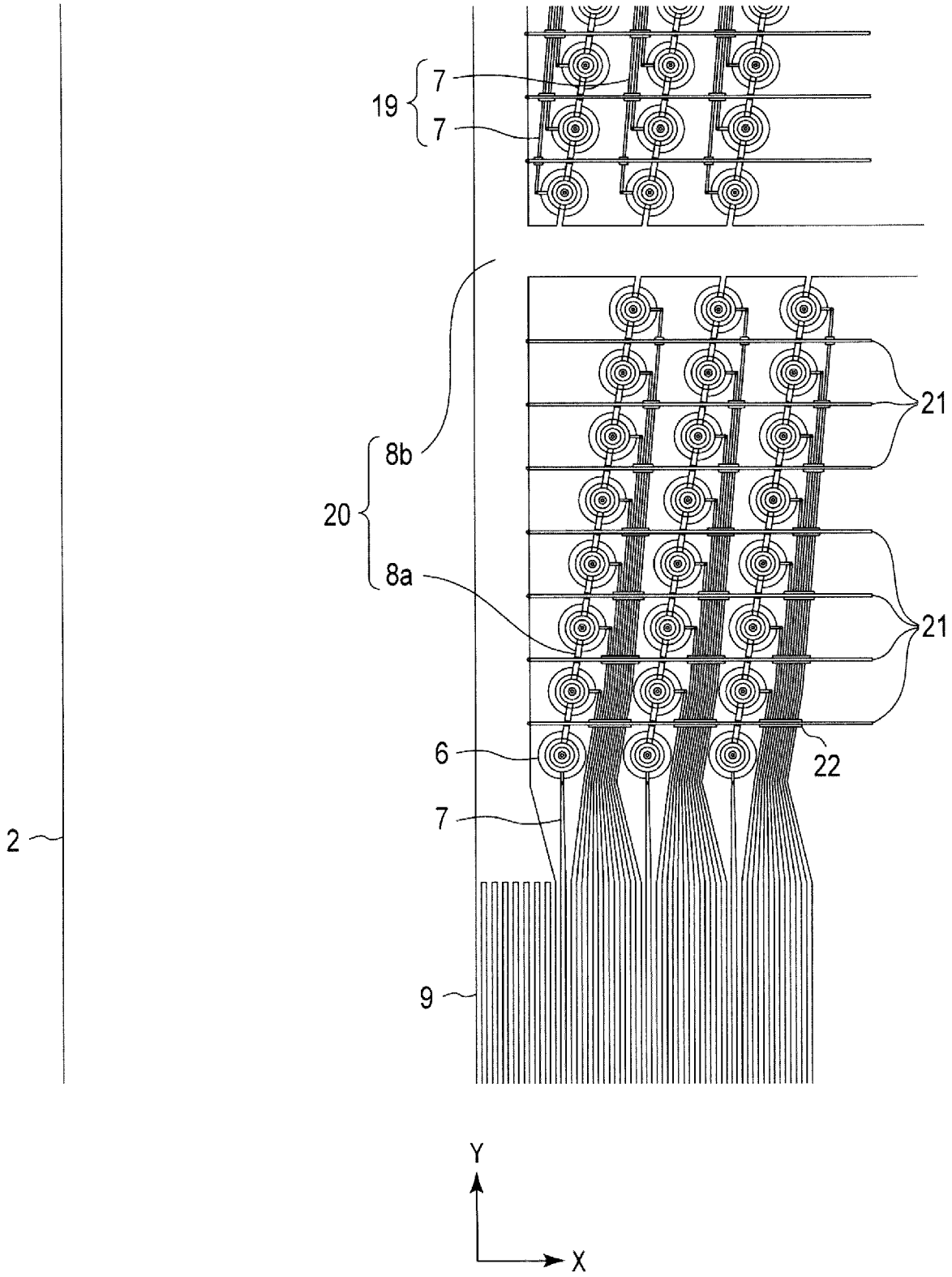
FIG. 2 is a plan view illustrating a partial configuration of the flow path substrate according to the first embodiment.

FIG. 2 illustrates a plan view of a wiring pattern on the flow path substrate 2 according to the first embodiment. The portion in which the same wiring pattern is repeated is omitted. A plurality of the actuators 6, a plurality of the individual electrodes 7, common electrodes 8*a* and 8*b*, and a plurality of mounting pads 9 are formed on the flow path substrate 2. The common electrodes 8*a* or 8*b* may be generally referred as the common electrode 8.

The mounting pad 9 is electrically connected to the driving circuit 5 through the plurality of wiring patterns formed on the flexible wiring board 4. An anisotropic conductive film (ACF) can be used to connect the mounting pad 9 and the flexible wiring board 4. In addition, the mounting pad 9 may be connected to the driving circuit 5 using a method such as wire bonding or the like.

Each individual electrode 7 is connected to each actuator 6 individually and independently. The first wiring pattern 19 includes a plurality of individual electrodes 7, which are individually and independently provided.

The second wiring pattern 20 includes a plurality of common electrodes 8*a* and 8*b*. The common electrode 8*b* is electrically connected to the mounting pad 9 at an end portion. The common electrode 8*a* branches off from the common electrode 8*b*, and is electrically connected to a plurality of actuators 6 that are adjacent to each other.

Figure 3:
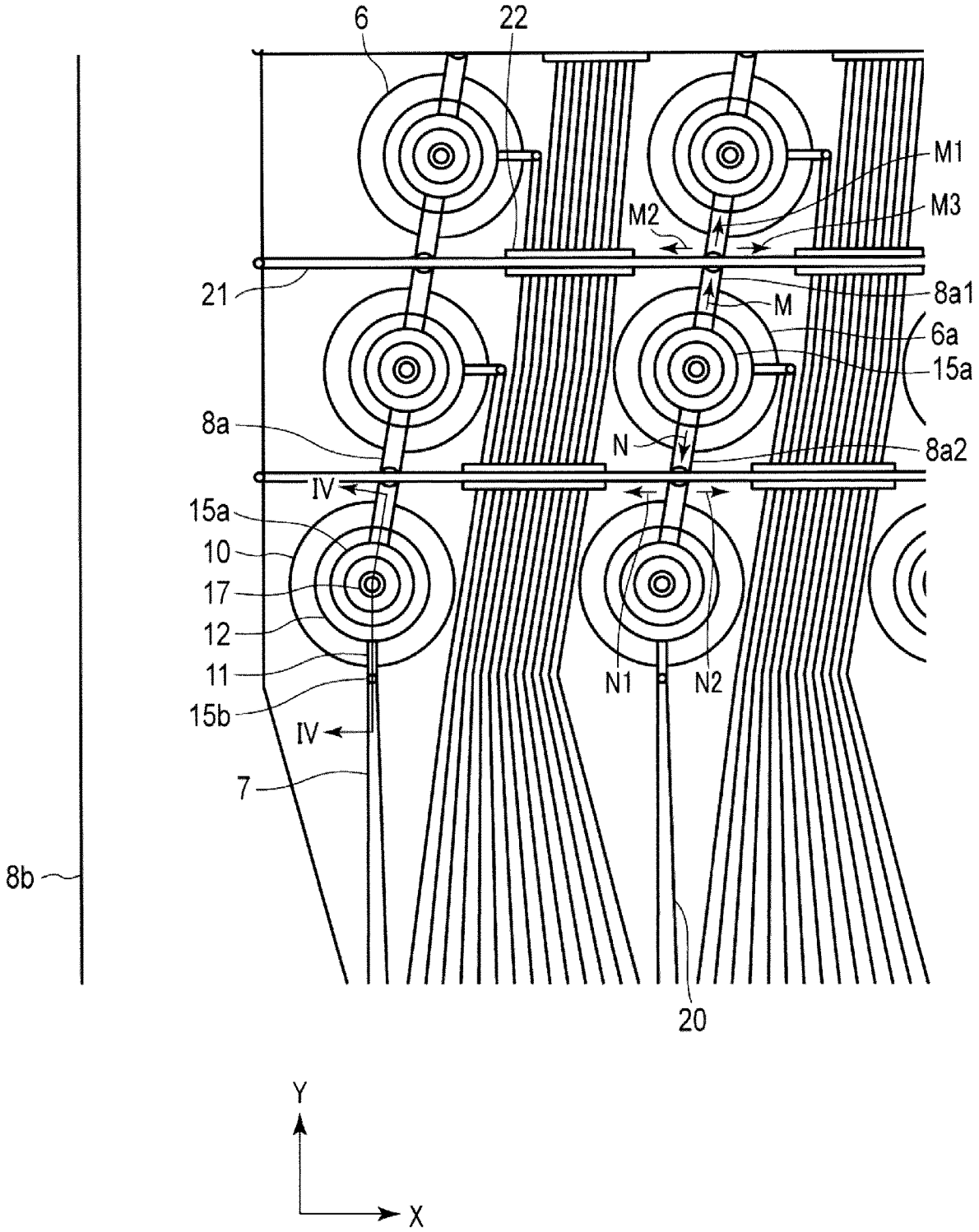
FIG. 3 is a partially enlarged view of FIG. 2, and a plan view illustrating the detail of an actuator.
Figure 4:
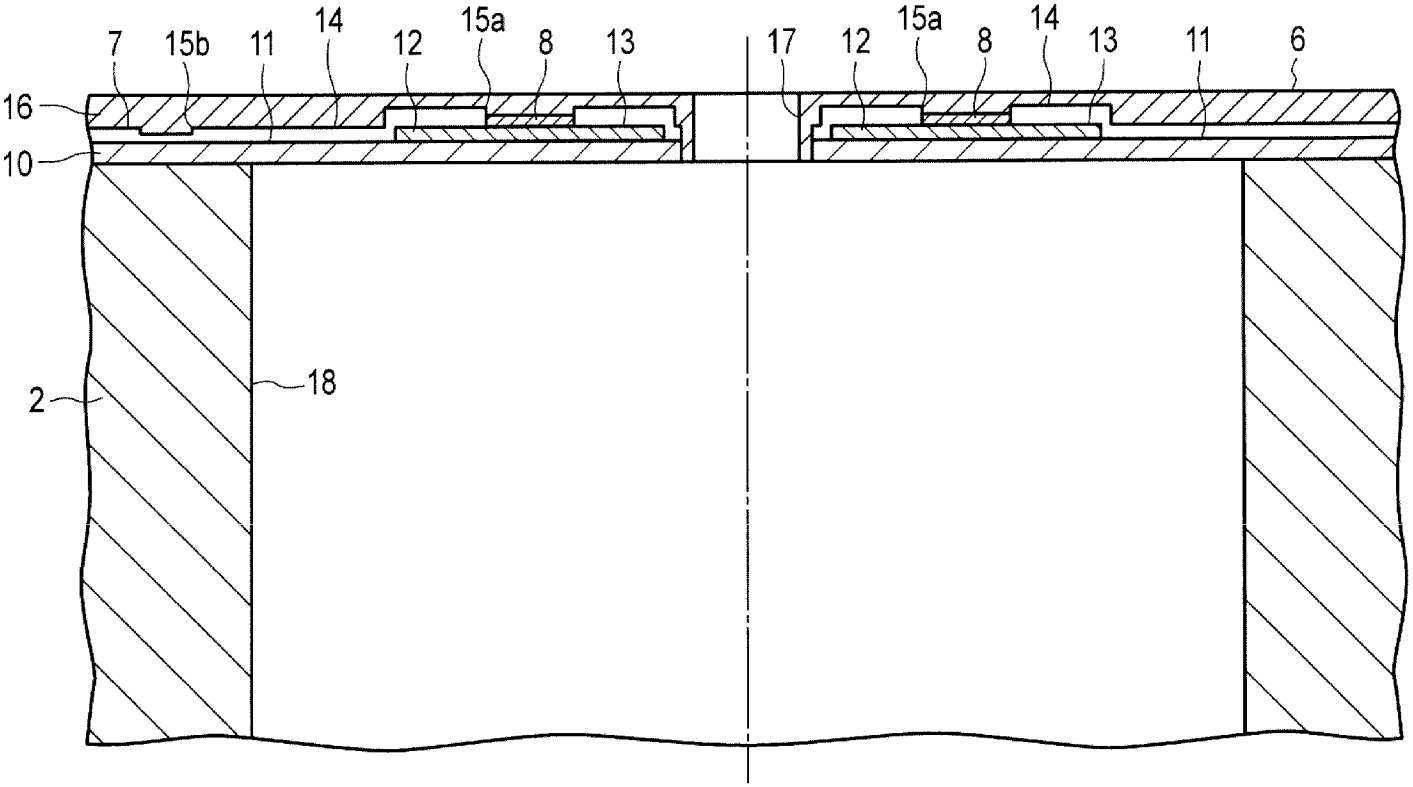
FIG. 4 is a sectional view taken along line IV-IV in FIG. 3.

FIG. 3 is a plan view illustrating an enlarged view of wiring patterns of the flow path substrate 2. FIG. 4 is a vertical sectional view of the flow path substrate 2 taken along the line IV-IV in FIG. 3.

As illustrated in FIG. 4, an actuator 6 includes a vibrating plate 10, a lower electrode 11, a piezoelectric body 12, an upper electrode 13, a first insulating layer 14, a common electrode 8, a protective layer 16, and a nozzle 17.

The flow path substrate 2 includes a single crystal silicon wafer with a thickness of 500 μm, as an example. A plurality of pressure chamber 18, which is filled with ink, is formed inside the flow path substrate 2. The diameter of the pressure chamber 18 is set as 200 μm, as an example. The pressure chamber 18 is formed by forming a hole from the lower surface of the flow path substrate 2 using dry etching, for example.

A vibrating plate 10 is integrally formed on the flow path substrate 2 to cover the top surface of the pressure chamber 18. The vibrating plate 10 includes silicon dioxide, which is a silicon oxide film formed using thermal oxidation, by heating the single crystal silicon wafer of the flow path substrate 2 at a high temperature before forming the pressure chamber 18. A through hole, which is larger than the nozzle 17, is formed in the vibrating plate 10 concentric with the nozzle 17. The thickness of the vibrating plate 10 is set as 4 μm, as an example.

A stacked body of the lower electrode 11, the piezoelectric body 12, and the upper electrode 13 is formed on the vibrating plate 10 in a toroidal shape around the nozzle 17. The inner and outer diameter of the stacked body is set as 30 μm and 140 μm, respectively, as an example. The lower electrode 11, the piezoelectric body 12, and the upper electrode 13 are, as an example, films of platinum, lead zirconate titanate (PZT), and platinum, respectively, formed by sputtering method. The thickness of the upper electrode 13 and the lower electrode 11 is set as 0.1 μm to 0.2 μm, respectively, as an example. The thickness of the PZT is set as 2 μm, as an example. In addition, PZT may be formed as a film using the sputtering method or the like.

The piezoelectric body 12 has an orientation direction (polarization direction) that is determined during the formation of the film and causes polarization in the thickness direction. According to the embodiment whereby the piezoelectric body 12 is formed as a film on the lower electrode 11 using sputtering method, the polarization direction of the piezoelectric body film is oriented from the lower electrode 11 toward the upper electrode 13.

Figure 5B:
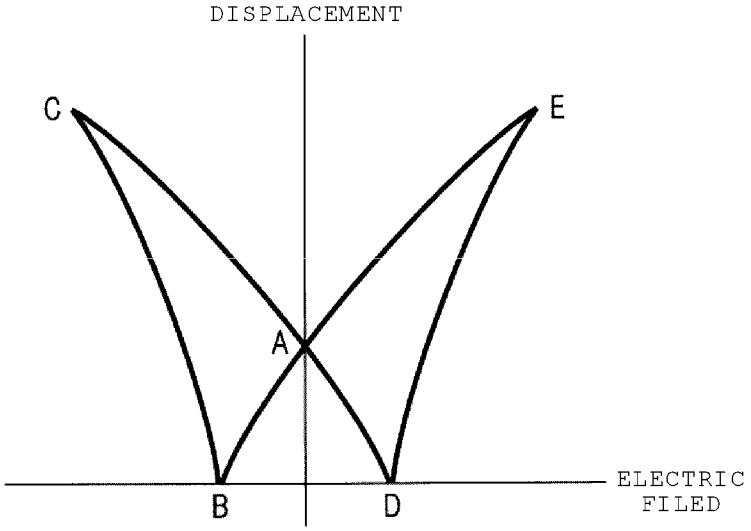
FIGS. 5A and 5B illustrate the hysteresis and the butterfly displacement curve of a ferroelectric body.
Figure 5A:
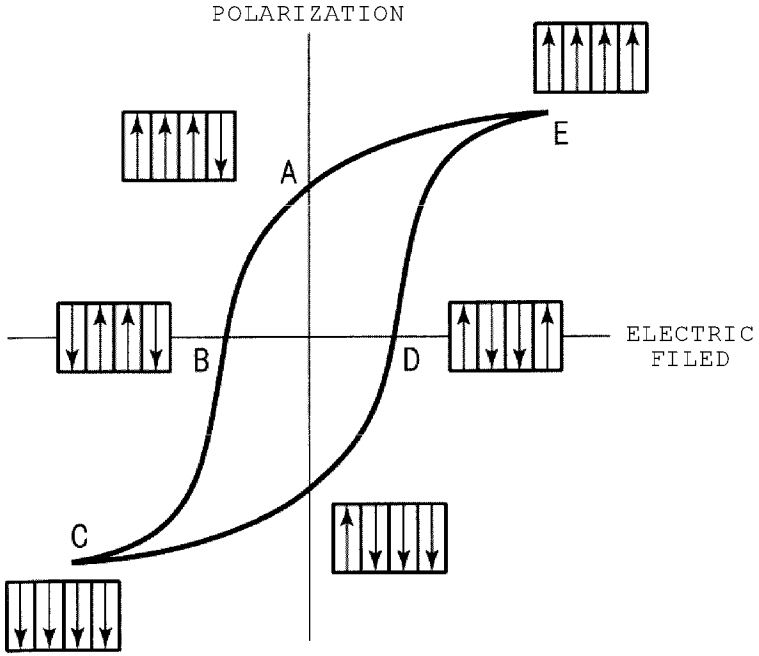

FIGS. 5A and 5B illustrate characteristics (A), which are referred to as hysteresis of the piezoelectric body 12 as a ferroelectric, and characteristics (B), which are referred to as a butterfly displacement curve. As illustrated in FIGS. 5A and 5B, when applying an electric field with a direction opposite to the polarization direction to the piezoelectric body 12 (A→B→C), displacement decreases with the intensity of the electric field from A to B, but increases from B to C. This complicates operating characteristics of the actuator 6 and causes difficulty in controlling its displacement. On the other hand, by applying an electric field in the same direction as the polarization direction of the piezoelectric body 12 (A→E), control thereof becomes less complicated since the displacement monotonously increases with the increase in the intensity of the electric field. Accordingly, it is preferable to apply an electric field in the same direction as the polarization direction, like (A→E), rather than applying an electric field in a direction opposite to the polarization direction, like (A→B→C), since displacement is approximately proportional to the electric field.

In addition, it is known that a cost of a driving IC or a power supply device that supplies a negative voltage is high (approximately several to several tens of times), compared to that for a positive voltage. Accordingly, in order to perform driving by applying an electric field in the same direction as the polarization direction of the piezoelectric body 12, and cause liquid to be ejected from the nozzle 17, a first method of applying a positive voltage to the upper electrode 13 from a driving source can be employed. The first method includes applying the positive voltage to the upper electrode 13 and setting the lower electrode 11 to ground. Alternatively, a second method can be employed by applying the positive voltage to the lower electrode 11 and setting the upper electrode 13 to ground. The second method is preferred over the first method to avoid additional step of performing polarization reverse process in order to orient the polarization direction of the piezoelectric body 12 from the upper electrode 13 toward the lower electrode 11.

When an electric field is applied only in the same direction as the polarization direction, the piezoelectric body 12 extends in the film thickness direction as a result of the applied electric field and contracts in a direction orthogonal to the film thickness (in-plane direction).

As illustrated in FIG. 4, the first insulating layer 14 is formed on the upper electrode 13. Two contact holes (first contact hole 15*a* and second contact hole 15*b*) are formed on the first insulating layer 14. The first contact hole 15*a* is an opening formed in a toroidal shape, and the upper electrode 13 and the common electrode 8 are electrically connected through the first contact hole 15*a*. The second contact hole 15*b* is a circular opening formed at a position corresponding to the peripheral wall portion of the pressure chamber 18 of the flow path substrate 2, through which the lower electrode 11 and the individual electrode 7 are electrically connected.

The first insulating layer 14 is obtained by forming a silicon dioxide film using, as an example, a tetraethoxysilane (TEOS)-chemical vapor deposition (CVD) method. The thickness of the first insulating layer 14 is 0.5 μm, as an example. The first insulating layer 14 prevents the common electrode 8 and the lower electrode 11 from being in electrical contact at the outer peripheral portion of the piezoelectric body 12.

The individual electrode 7, the common electrode 8, and the mounting pad 9 are formed on the first insulating layer 14. The individual electrode 7 is connected to the lower electrode 11 through the second contact hole 15*b*. The common electrode 8 is connected to the upper electrode 13 through the first contact hole 15*a*. The individual electrode 7, the common electrode 8, and the mounting pad 9 are fabricated by forming a film using gold, using a sputtering method, as an example. The thickness thereof is set as 0.1 μm to 0.5 μm, as an example.

A protective layer 16 is formed on the individual electrode 7, the common electrode 8, and the first insulating layer 14. A circular nozzle 17, which communicates with the pressure chamber 18, is open to the protective layer 16. A thickness of the protective layer 16 is set as 4 μm, as an example, and a diameter of the nozzle 17 is set as 20 μm, as an example. The protective layer 16 is obtained by forming a film using a photosensitive polyimide material, using spin coating method, as an example. The nozzle 17 is fabricated by performing exposer developing with respect to the photosensitive polyimide material, which is the protective layer 16, as an example.

The first wiring pattern 19 and the second wiring pattern 20 are separated without being electrically connected to each other on the vibrating plate 10.

In addition, according to the embodiment, a third wiring pattern 21 is formed. The third wiring pattern 21 is electrically connected to the second wiring pattern 20 at intersections with the common electrode 8*a*. In order to prevent the third wiring pattern 21 from causing an electrical short-circuit with the first wiring pattern 19, a second insulating layer 22 is interposed between the third wiring pattern 21 and the first wiring pattern 19 at points of intersection, as an example.

The following describes the operational effect with the aforementioned configuration. An actuator 6*a* as one of the plurality of actuators 6 in FIG. 3 will be described as an example. A current path of the actuator 6*a* extends from the individual electrode 7 and the second contact hole 15*b* to the first contact hole 15*a* and the common electrode 8*a* through the piezoelectric body 12. There are two possible main current paths (M and N) from the first contact hole 15*a*, where the current path M is through a common electrode 8*a*1, which extends in an upper direction of the actuator 6*a*, and the current path N is through a common electrode 8*a*2, which extends in a lower direction in FIG. 3. In addition, due to a connection between the second wiring pattern 20 and the third wiring pattern 21, three current sub-paths (M1, M2, and M3) extend from the main current path M. Two current sub-paths (N1 and N2) extend from the main current path N. In this manner, the current path from one actuator 6*a* includes five current sub-paths in total.

Therefore, according to the embodiment, the upper electrode 13 of the actuator 6 is connected to a common electrode 8*a* of the second wiring pattern 20, disposed between the outer peripheral portions of the plural piezoelectric bodies 12. The second wiring pattern 20 is electrically connected to ground and the third wiring pattern 21. The first wiring pattern 19 intersects the third wiring pattern 21 without being electrically connected thereto by interposing a second insulating layer 22. In this manner, since a plurality of current paths (sub-paths) are formed for the common electrodes 8 for all actuators 6, even when any of the common electrodes 8 of the plurality of current paths (sub-paths) is disconnected, it is possible to maintain an electrical connection through another common electrode 8 that is not disconnected. For this reason, it is possible for the actuator 6 to secure a connection with the common electrode 8, even when there is a disconnection or electrical breakdown in any one of the plurality of current paths (sub-paths).

Figure 6:
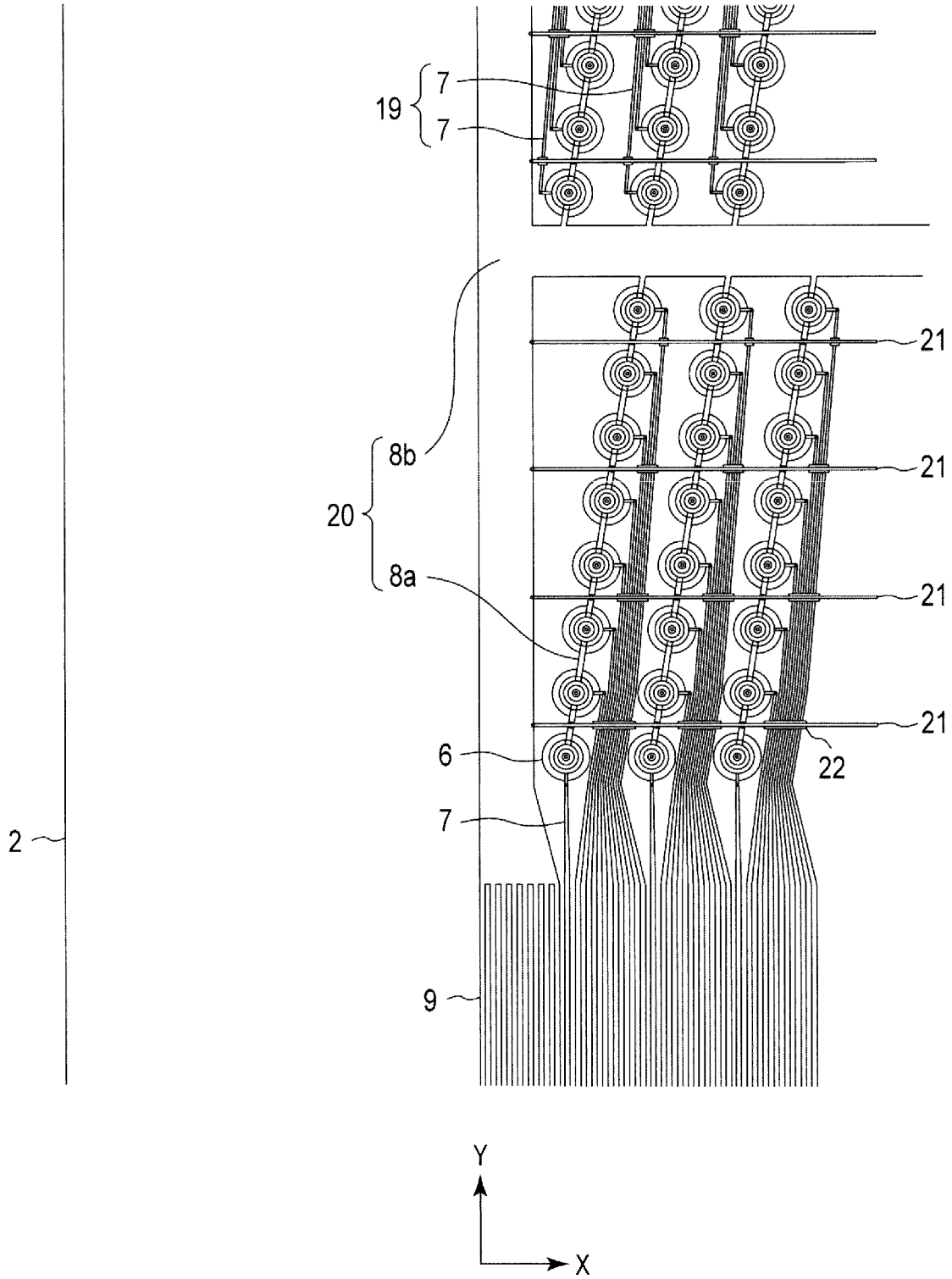
FIG. 6 is a plan view illustrating a wiring pattern according to a second embodiment.

Subsequently, a second embodiment will be described with reference to FIG. 6. In the embodiment, the third wiring pattern 21 according to the first embodiment is modified as follows. That is, in FIG. 6, a configuration in which the number of third wiring patterns 21 that extend in the X direction is reduced compared to that according to the first embodiment. In addition, one common electrode 8 of the third wiring pattern 21 is arranged in respective two actuators 6 that are adjacent to each other in the Y direction. Also in this case, as the first embodiment, all of the actuators 6 can form a plurality of current paths (subs-paths) in the common electrode 8, respectively. For this reason, it is possible for the actuator 6 to secure a connection with the common electrode 8, even when a disconnection or electrical breakdown occurs in any one of the plurality of current paths (subs-paths).

Figure 7:
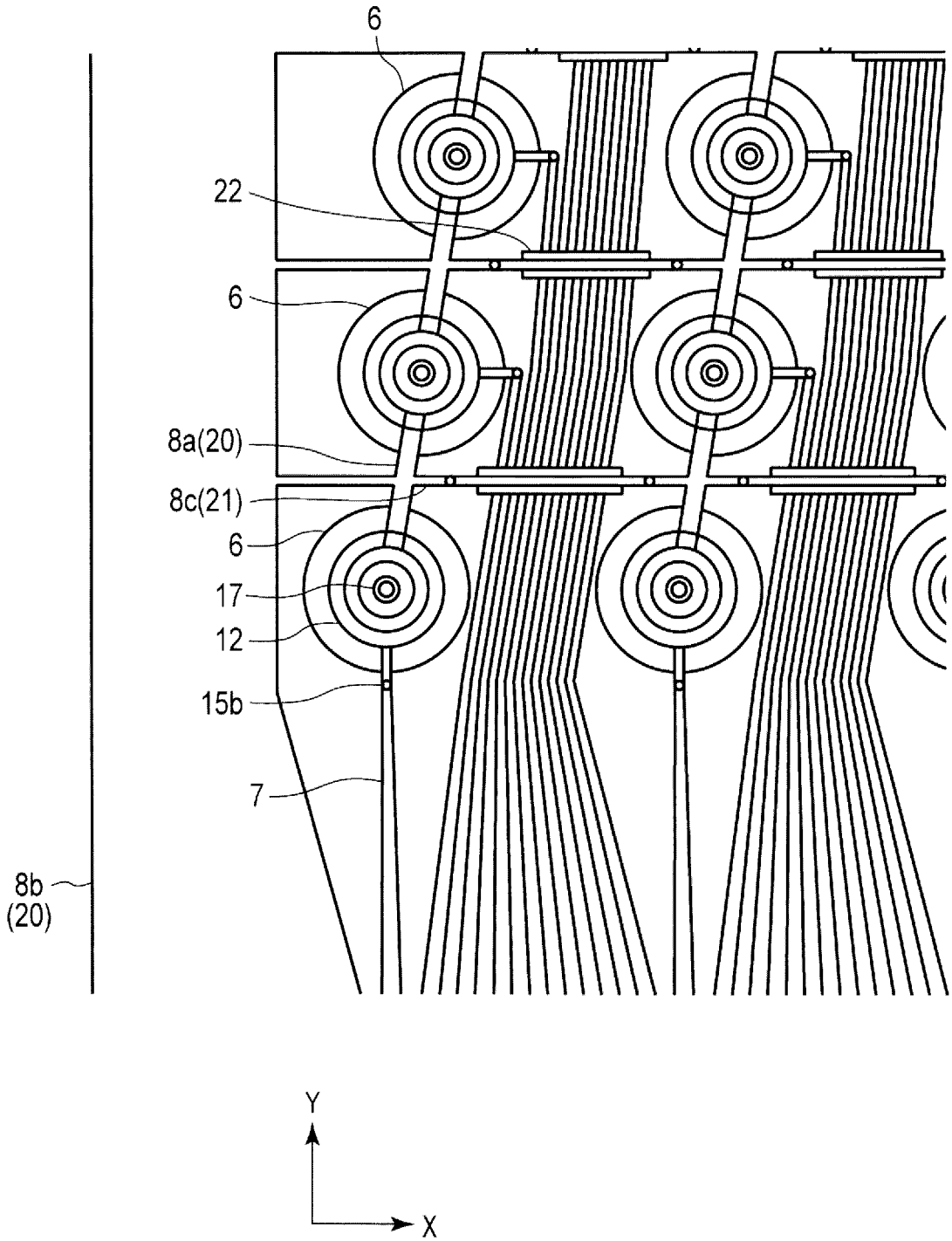
FIG. 7 is a partially enlarged view of a wiring pattern according to a third embodiment, and a plan view illustrating the detail of an actuator.

FIG. 7 is a plan view illustrating a partially enlarged view of a wiring pattern according to a third embodiment, and a plan view of a detail of an actuator. According to the embodiment, the first wiring pattern 19 includes a plurality of individual electrodes 7, similar to the first embodiment.

Unlike the first embodiment, the second wiring pattern 20 includes a common electrode 8*c*, which branches off from the common electrode 8*a* and extends onto the vibrating plate 10, in addition to the common electrodes 8*a* and 8*b*. The second wiring pattern 20 includes the plurality of common electrodes 8*a*, 8*b*, and 8*c*, and is separated from the first wiring pattern 19 without being electrically connected thereto. In addition, the third wiring pattern 21 includes the common electrode 8*c*, and is electrically connected to the second wiring pattern 20 through the common electrode 8*c*.

Like the first embodiment, according to the embodiment, in each actuator 6, two or more current paths are created, and it is possible to secure a connection with the common electrode 8 even when there is a disconnection or electrical breakdown in any one of the current paths.

According to the embodiment, a portion of the third wiring pattern is integrated with the second wiring pattern 20 using the common electrode 8*c*. For this reason, according to the embodiment, the number of steps or level differences of the common electrode 8*a* and the second insulating layer 22, over which the third wiring pattern 21 is disposed, is halved as compared to a case in which the third wiring pattern 21 is formed separately from the common electrode 8*a*, like the first embodiment. For this reason, it is possible to reduce a risk of a disconnection or a high resistance between the third wiring pattern 21 and the common electrode 8.

Figure 8:
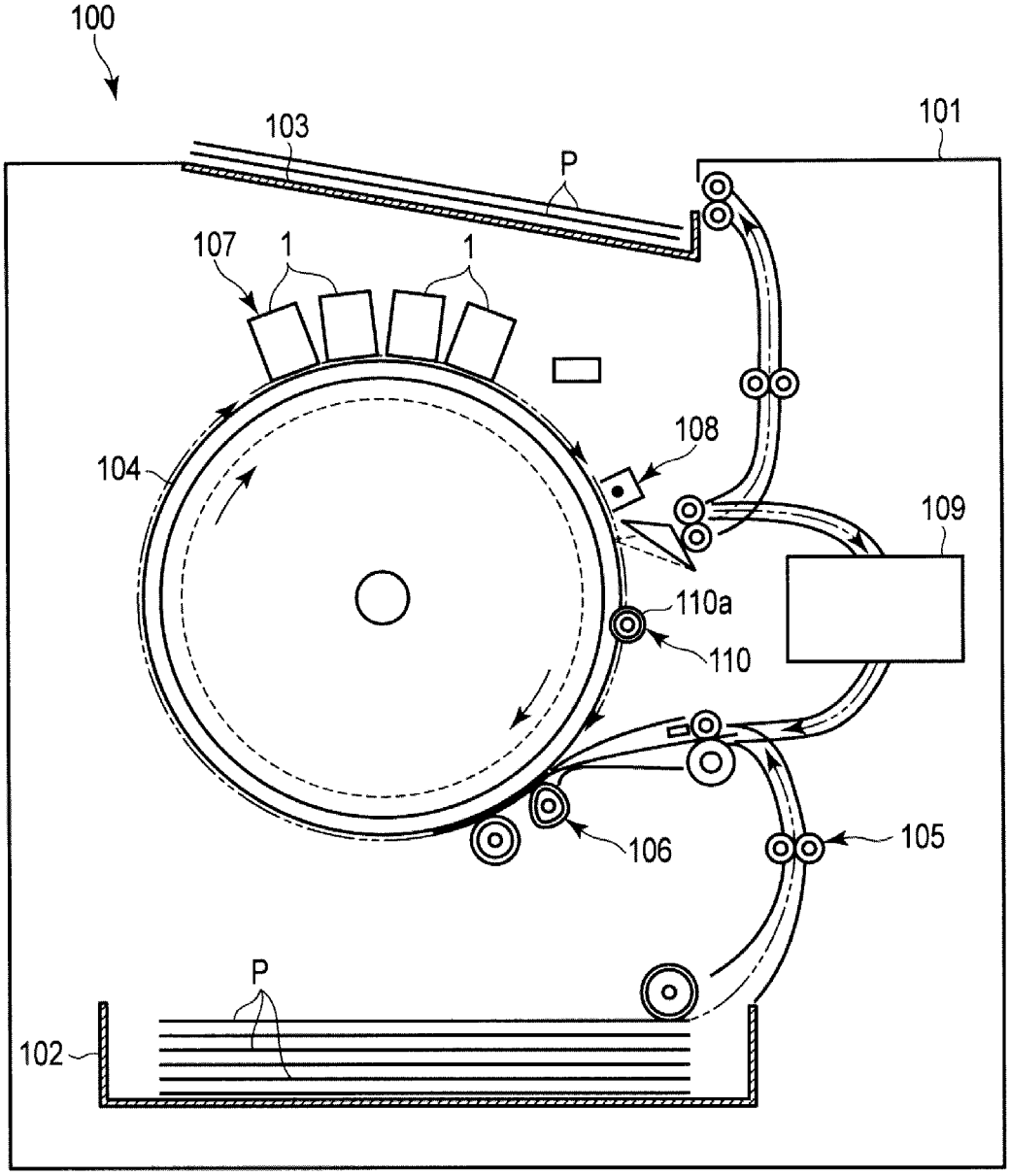
FIG. 8 is a schematic view of an ink jet recording apparatus including the ink jet head according to the first embodiment.

Subsequently, an ink jet recording apparatus 100 including the above described ink jet head 1 will be described with reference to FIG. 8. FIG. 8 is a schematic view for describing an example of the ink jet recording apparatus 100. The ink jet recording apparatus 100 also can be referred to as an ink jet printer. In addition, the ink jet recording apparatus 100 may be a device such as a copier.

The ink jet recording apparatus 100 performs various processings, such as forming an image while transporting a recording sheet P as a recording medium, or the like. The ink jet recording apparatus 100 includes a housing 101, a sheet feeding cassette 102, a sheet discharging tray 103, a holding roller (drum) 104, a transport unit 105, a holding unit 106, an image forming unit 107, a neutralizing and separating unit 108, a reversing unit 109, and a cleaning unit 110.

The housing 101 accommodates each unit of the ink jet recording apparatus 100.

The sheet feeding cassette 102 is arranged inside the housing 101 while accommodating a plurality of recording sheets P.

The sheet discharging tray 103 is located above the housing 101. The recording sheet P on which an image is formed by the ink jet recording apparatus 100 is discharged to the sheet discharging tray 103.

The holding roller 104 includes a cylindrical frame that includes a conductive body, and a thin insulating layer formed on the surface of the frame. The frame is grounded (connected to ground). The holding roller 104 transports the recording sheet P by rotating in a state of holding the recording sheet P on the surface thereof.

The transport unit 105 includes a plurality of guides and transport rollers that are arranged along a path through which the recording sheet P is transported. The transport roller rotates by being driven by a motor. The transport unit 105 transports the recording sheet P to which ink ejected from the ink jet head 1 is attached from the sheet feeding cassette 102 to the sheet discharging tray 103.

The holding unit 106 causes the recording sheet P, which is transported from the sheet feeding cassette 102 using the transport unit 105, to hold on to the surface (outer peripheral surface) of the holding roller 104 by being adsorbed. The holding unit 106 causes the recording sheet P to be adsorbed to the holding roller 104 using an electrostatic force due to charging, after pressing the recording sheet P to the holding roller 104.

The image forming unit 107 forms an image on the recording sheet P, which is held onto the outer surface of the holding roller 104 using the holding unit 106. The image forming unit 107 includes the plurality of ink jet heads 1 that face the surface of the holding roller 104. The plurality of ink jet heads 1 form an image by ejecting ink of four colors (e.g., cyan, magenta, yellow, and black) onto the recording sheet P, respectively.

The neutralizing and separating unit 108 separates the recording sheet P from the holding roller 104 by performing neutralizing with respect to the recording sheet on which an image is formed. The neutralizing and separating unit 108 performs neutralizing with respect to the recording sheet P by providing a charge, and inserts a claw between the recording sheet P and the holding roller 104. In this manner, the recording sheet P is separated from the holding roller 104. The recording sheet P separated from the holding roller 104 is transported to the sheet discharging tray 103 or the reversing unit 109 using the transport unit 105.

The reversing unit 109 turns the recording sheet P inside out, which is separated from the holding roller 104, and supplies the recording sheet P onto the surface of the holding roller 104 again. The reversing unit 109 reverses the recording sheet P by transporting the recording sheet P along a predetermined reversing path which causes the recording sheet P to switch back in an opposite direction in the anterior-posterior direction, for example.

The cleaning unit 110 cleans the holding roller 104. The cleaning unit 110 is located on the downstream side of the neutralizing and separating unit 108 in a rotating direction of the holding roller 104. The cleaning unit 110 cleans the surface of the holding roller 104 which rotates, by bringing a cleaning member 110*a* into contact with the surface of the holding roller 104 which rotates.

According to embodiments, it is possible to provide an ink jet head and an ink jet recording apparatus that can reliably maintain an electrical connection even when any one of the common electrodes in a high density nozzle is disconnected.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein maybe made without departing from the spirit of the inventions. The accompanying claims and their equivalents are intended to cover such forms or modifications as would fall within the scope and spirit of the inventions.

What is claimed is:

1. An ink jet head comprising:

a vibrating plate having a plurality of nozzles;

a plurality of actuators arranged on the vibrating plate, each of the plurality of actuators having a piezoelectric body;

a plurality of individual electrodes having a first wiring pattern disposed on the vibrating plate, each of the plurality of individual electrodes being electrically connected to the piezoelectric body of each of the plurality of actuators;

a common electrode having a plurality of second wiring patterns disposed on the vibrating plate so that the second wiring patterns do not overlap with the first wiring pattern, each of the plurality of second wiring patterns being electrically connected to the piezoelectric body of each of the plurality of actuators across spaces between the plurality of piezoelectric bodies; and a third wiring pattern disposed on the vibrating plate, extends in a direction different from a direction of the second wiring pattern, and is electrically connected to the second wiring pattern, wherein the second wiring pattern is connected to two current paths of any one of the plurality of actuators.

2. The ink jet head according to claim 1, further comprising an insulation layer provided between the first and third wiring pattern.

3. The ink jet head according to claim 2, wherein the second wiring pattern is respectively connected to the plurality of actuators.

4. The ink jet head according to claim 3, wherein the first wiring patterns are arranged between neighboring second wiring patterns, and a number of the first wiring patterns is equal to a number of actuators connected to one of the neighboring second wiring patterns.

5. The ink jet head according to claim 4, wherein end portions of the first wiring patterns extend in parallel and are connected to the actuator.

6. The ink jet head according to claim 2, wherein one of the plurality of actuators is surrounded by the adjacent first and third wiring pattern.

7. The ink jet head according to claim 2, wherein the plurality of actuators are surrounded by the adjacent first and third wiring pattern.

8. The ink jet head according to claim 7, wherein the plurality of actuators are arranged in a direction along which the first wiring pattern extends.

9. The ink jet head according to claim 2, wherein the individual electrodes are connected to the first wiring pattern according to address, and the common electrode is connected to the second and third wiring pattern as a ground.

10. The ink jet head according to claim 1, wherein the third wiring pattern is not electrically connected to the first wiring pattern.

11. The ink jet head according to claim 10, wherein one of the plurality of actuators is surrounded by the adjacent first and third wiring pattern.

12. The ink jet head according to claim 10, wherein the plurality of actuators are surrounded by the adjacent first and third wiring pattern.

13. The ink jet head according to claim 12, wherein the plurality of actuators are arranged in a direction along which the first wiring pattern extends.

14. An image forming apparatus comprising:

an ink jet head;

a roller configured to convey a sheet;

the ink jet head comprising:

a vibrating plate having a plurality of nozzles;

a plurality of actuators arranged on the vibrating plate, each of the plurality of actuators having a piezoelectric body;

a plurality of individual electrodes having a first wiring pattern disposed on the vibrating plate, each of the plurality of individual electrodes being electrically connected to the piezoelectric body of each of the plurality of actuators;

a common electrode having a plurality of second wiring patterns disposed on the vibrating plate so that the second wiring patterns do not overlap with the first wiring pattern, each of the plurality of second wiring patterns being electrically connected to the piezoelectric body of each of the plurality of actuators across spaces between the plurality of piezoelectric bodies; and a third wiring pattern disposed on the vibrating plate, extends in a direction different from a direction of the second wiring pattern, and is electrically connected to the second wiring pattern, wherein each second wiring pattern is connected to two current paths of one of the plurality of actuators.

15. The image forming apparatus according to claim 14, further comprising an insulation layer provided between the first and third wiring pattern.

16. The image forming apparatus according to claim 15, wherein the one of the plurality of actuators is surrounded by the adjacent first and third wiring pattern.

17. The image forming apparatus according to claim 15, wherein the plurality of actuators are surrounded by the adjacent first and third wiring pattern.

18. The image forming apparatus according to claim 17, wherein the plurality of actuators are arranged in a direction along which the first wiring pattern extends.

19. The image forming apparatus according to claim 14, wherein the third wiring pattern extends between two pairs of adjacent actuators in the plurality of actuators and is connected to one of the plurality of second wiring patterns that electrically connects to the two pairs of adjacent actuators.

20. The inkjet head according to claim 1, wherein the third wiring pattern extends between two pairs of adjacent actuators in the plurality of actuators and is connected to one of the plurality of second wiring patterns that electrically connects to the two pairs of adjacent actuators.

* * * * *